United States Patent [19]

Donovan

[11] 4,446,465

[45] May 1, 1984

[54] LOW WINDLOAD CIRCULARLY POLARIZED ANTENNA

[75] Inventor: Joseph A. Donovan, Quincy, Ill.

[73] Assignee: Harris Corporation, Melbourne, Fla.

[21] Appl. No.: 375,868

[22] Filed: May 2, 1982

Related U.S. Application Data

[63] Continuation of Ser. No. 957,030, Nov. 2, 1978, abandoned, which is a continuation of Ser. No. 800,539, May 25, 1977, abandoned.

[51] Int. Cl.[3] ..... H01Q 21/26

[52] U.S. Cl. ..... 343/797; 343/800

[58] Field of Search ..... 343/797–800, 343/890, 891

[56] References Cited

U.S. PATENT DOCUMENTS

| | | | |
|---|---|---|---|
| 2,539,433 | 1/1951 | Kandoian | 343/800 |
| 2,631,237 | 3/1953 | Sichak et al. | 343/800 |
| 3,618,105 | 11/1971 | Bruene et al. | 343/797 |
| 3,702,479 | 11/1972 | Uhrig | 343/797 |
| 3,725,943 | 4/1973 | Spanos | 343/797 |
| 3,765,023 | 10/1973 | Ben-Dou | 343/797 |
| 4,031,539 | 6/1977 | Woodward | 343/797 |
| 4,062,019 | 12/1977 | Woodward et al. | 343/797 |

FOREIGN PATENT DOCUMENTS

| | | | |
|---|---|---|---|
| 875281 | 8/1961 | United Kingdom | 343/800 |

*Primary Examiner*—Eli Lieberman

*Attorney, Agent, or Firm*—Yount & Tarolli

[57] ABSTRACT

A circularly polarized (CP) antenna comprised of at least one antenna bay. Each bay includes three individual CP antennas which are equally spaced circumferentially about a mast. Each individual CP antenna is comprised of a pair of crossed dipoles having drooping arms. The angle at which the arms droop is selected to provide good axial ratio at all positions in the vertical and horizontal patterns. Three reflectors extend radially from the mast and are arranged at circumferential positions intermediate the individual CP antennas. In one embodiment, six antenna bays of this type are provided at axially spaced positions along a single, common mast. An arrangement for feeding this multi-bay antenna is also disclosed.

9 Claims, 5 Drawing Figures

LOW WINDLOAD CIRCULARLY POLARIZED ANTENNA

This is a continuation of application Ser. No. 957,030, filed Nov. 2, 1978, now abandoned, which is a continuation of application Ser. No. 800,539, filed May 25, 1977, also abandoned.

BACKGROUND OF THE INVENTION

The present invention relates to circularly polarized broadcasting antennas, and more particularly to a broadcasting antenna comprised of plural, crossed dipoles.

Until recently, television broadcasting in the United States has almost exclusively used horizontally polarized antennas. The horizontally polarized antenna which has become most popular for VHF television broadcasting purposes is the superturnstile, or batwing, antenna. Batwing antennas provide very low windload and have extremely good electrical performance. Nonetheless, much effort has recently been directed toward devising a circularly polarized (CP) antenna which could replace existing batwing antennas. This interest in CP antennas is largely due to a recognition that reception problems associated with the use of linearly polarized broadcasting antennas and receiving antennas, such as television image "ghosting", canyon effects, and multipath interference, could be substantially avoided if CP antennas were instead used.

In order to replace a batwing-type broadcasting antenna with a circularly polarized antenna, however, a CP antenna must be designed which will not only provide good electrical performance, but will also provide tower loading (weight and windload) which is not significantly greater than that of the antenna being replaced. If this is not the case, the entire tower might also have to be replaced in order to support the new antenna; the replacement cost may then be prohibitively high.

An antenna is described herein which may serve as a direct replacement for batwing antennas currently in use, and which provides very good electrical performance. In addition to a low windload factor, this antenna additionally has good axial ratio in both the vertical and horizontal patterns as well as good aperture efficiency.

In accordance with the present invention, a circularly polarized antenna is provided wherein at least one antenna bay is provided on an antenna mast. This antenna bay is comprised of three individual circularly polarized antennas, equally spaced circumferentially about the mast. Each individual circularly polarized antenna is comprised of a pair of crossed dipoles having drooping arms. The angle at which the arms droop is selected so that good axial ratio is achieved at all points in both the vertical and horizontal patterns. Three reflectors are provided which extend radially from the mast at circumferential positions intermediate the antennas so as to substantially isolate the radiation patterns provided by the three circularly polarized antennas.

Also in accordance with the present invention, several bays of this type are provided at axially spaced positions along a common mast, where the axial spacing is selected to provide optimal antenna gain. An antenna having high aperture efficiency is thereby provided.

BRIEF DESCRIPTION OF THE DRAWINGS

The foregoing and other objects and advantages of the present invention will become more readily apparent from the following description of a preferred embodiment, as taken in conjunction with the accompanying drawings which are a part hereof, and wherein.

DETAILED DESCRIPTION OF THE DRAWINGS

Although the invention will be described specifically with regards to a television broadcasting application, the invention has broader application to RF broadcasting in general and could easily be used, for example, as a top-mount FM broadcasting antenna.

Figure 1:
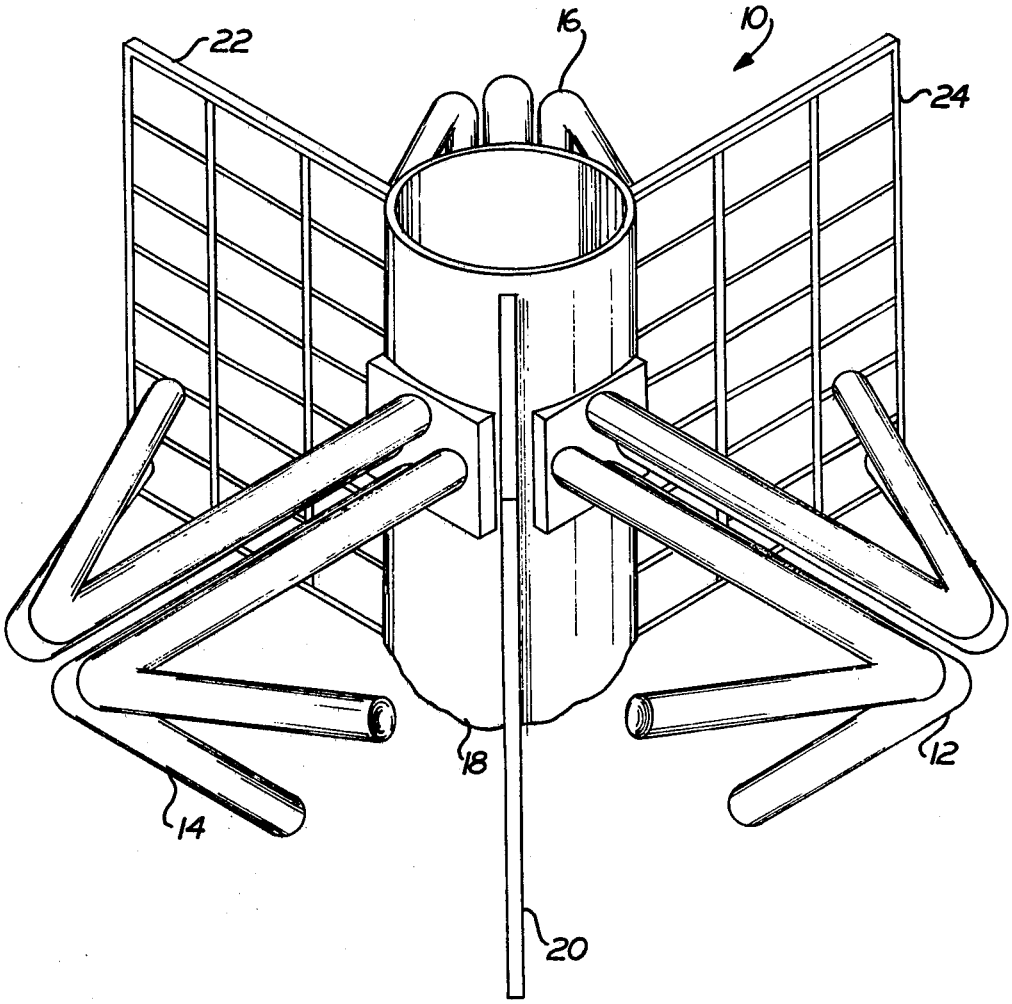
FIG. 1 is a perspective illustration of a circularly polarized antenna bay in accordance with the present invention.
Figure 2:
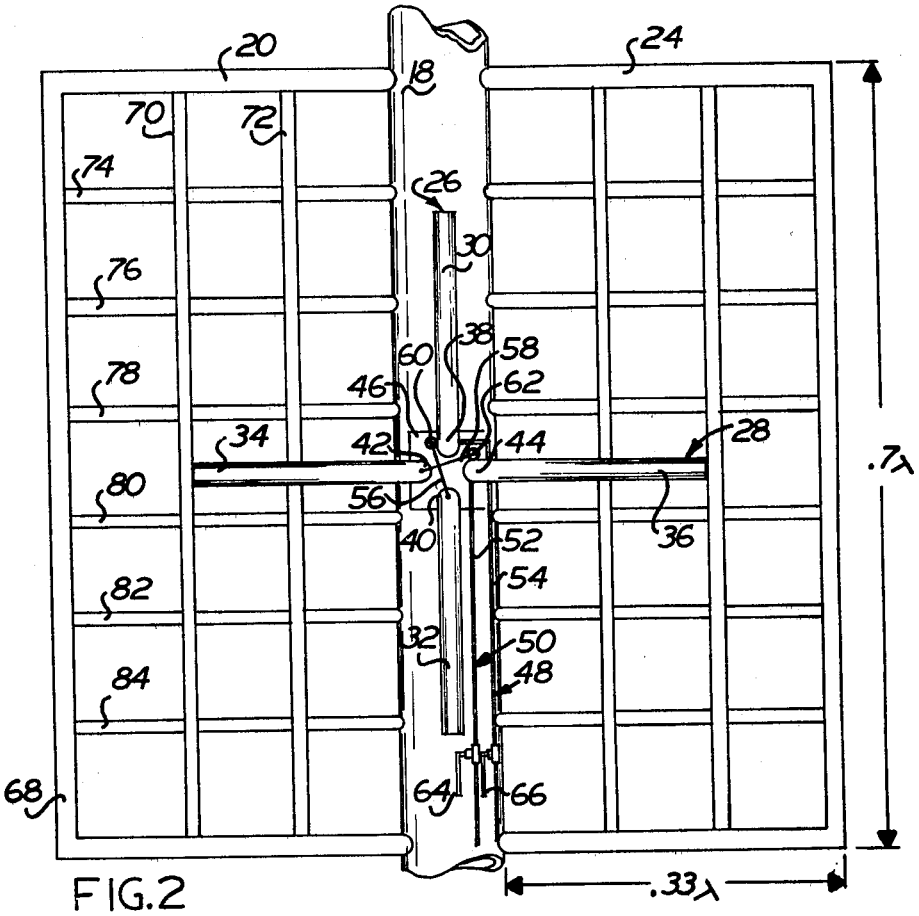
FIG. 2 is an elevation view of the antenna bay of FIG. 1.
Figure 3:
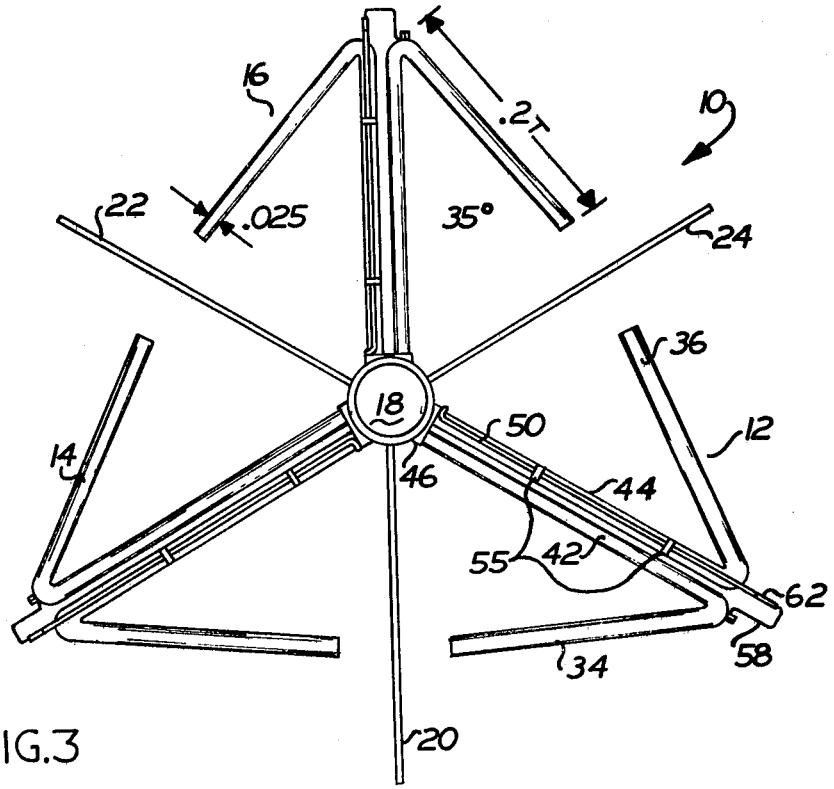
FIG. 3 is a plan view of the antenna bay illustrated in FIG. 1.

Referring first to FIGS. 1, 2, and 3, there is illustrated one bay of a circularly polarized antenna in accordance with the present invention. The antenna bay 10 consists of three circularly polarized antennas 12, 14, and 16 disposed at equally spaced circumferential positions about a mast 18. Each CP antenna is therefore separated from the other two by an angle of about 120°. These three antennas are separated by reflectors 20, 22, and 24 which are positioned intermediate the antennas. These reflectors establish ground planes behind each antenna and generally serve to isolate the radiation patterns of the three antennas so as to prevent interference therebetween.

Since the three circumferential faces of the antenna bay are preferably constructed identically, only the face including antenna 12 will be described in detail. As may be seen more clearly in FIG. 2, antenna 12 consists of a pair of crossed dipoles 26 and 28. Vertical dipole 26 includes radiating elements 30 and 32 while horizontal dipole 28 includes radiating elements (arms) 34 and 36. These dipole arms 30–36 will preferably have dimensions tailored to the wavelength ($\lambda$) of the signal being broadcast. Each will be approximately $0.2\lambda$ in length and will be constructed of metal tubing having a diameter of approximately $0.025\lambda$.

Dipoles 26 and 28 each serve to launch electromagnetic waves which are linearly polarized. Since dipoles 26 and 28 are disposed substantially perpendicularly with respect to one another, the sense of polarization of the electromagnetic waves transmitted by dipole 26 will be orthogonal to the polarization sense of the electromagnetic waves transmitted by dipole 28.

To broadcast circularly polarized electromagnetic waves from this arrangement, dipoles 26 and 28 will be fed with signals which are of equal magnitude, but which are 90° out of phase. When oriented and fed in this manner, circular polarization will be produced along the axis of the vertical and horizontal patterns of antenna 12, i.e., along the beam axis.

This alone, however, is not enough to insure that circular polarization will result at places in the field pattern other than along the beam axis. If, for example, straight (as opposed to drooping) dipoles were used, elliptical polarization would be produced at other places in the field pattern. This is because the E and H plane patterns of straight dipoles are not the same. Consequently, when two dipoles are oriented at 90° with respect to one another (thereby lining up the E plane pattern of one with the H plane pattern of the other, and vice versa) the field strength of one dipole will not be the same as the field strength of the other dipole at positions off the beam axis. Unless the field strengths are equal, however, circular polarization will not result.

It is for this reason that dipoles 26 and 28 have elements which are bent toward the mast. By bending the dipole elements toward the mast, the E and H plane patterns are modified and equalized so that the vertical and horizontal patterns of dipoles 26 and 28 will be co-extensive. Because of this, the polarization sense of the signal being broadcast will be substantially circular throughout the vertical and horizontal patterns, i.e. the antenna will have good axial ratio performance. It has been found that optimal axial ratio performance is secured when the dipole elements are disposed at an angle of 70° with respect to one another.

Each of the antenna elements 30, 32, 34, and 36 is therefore welded at an angle of 35° to a corresponding support member 38, 40, 42, and 44; all of which extend radially from the mast. These support members are welded to a mounting plate 46 which, in turn, may be attached to the mast in any convenient manner. In the illustrated embodiment, each dipole 26 and 28 is fed by a respective ⅞ inch coaxial feed line 48 and 50. These feed lines 48 and 50 each extend along mast 18 and radially outward along support members 38 and 44 respectively. Coaxial feed lines 48 and 50 have exposed outer conductors 52 and 54 and are secured to mast 18 and support members 38 and 44 in any suitable manner; e.g., by clamps 55. The outer conductor 52 and 54 of each feed line will therefore be shorted at multiple points to both mast 18 and a corresponding support member 38 or 44. The inner conductors 56 and 58 are exposed only at the end of the corresponding feed line, where each extends across the intervening gap between the corresponding dipole elements to the respective other dipole element 32 and 34. Teflon seals 60 and 62 may conveniently be included to provide pressure seals at the end of each feed line. These features may be seen most clearly in FIG. 3 where for ease of illustration, only those dipoles which are positioned transverse to the mast axis are shown.

Support members (38, 40) and (42, 44) serve as baluns and act as impedance transformers for coupling the unbalanced feed lines 48 and 50 to the balanced, center fed dipoles 26 and 28. In addition, tuning stubs 64 and 66 will be included for matching the impedance of feed lines 48 and 50 to the impedance of the dipole and balun assemblies.

As stated previously, the three faces of the antenna bay will be separated by reflectors 20, 22, and 24. Although these reflectors could be constructed of a continuous sheet of conductive material, such a scheme would provide a very high windload, and is undesirable for that reason. It is thus contemplated that each of the reflectors, for example reflector 20, will include a generally rectangular support frame 68 in which a grid of electrically conductive members is provided. In the illustrated embodiment, this grid consists of two vertically extending bars 70 and 72 and seven horizontally extending bars 74–84. Each bar of the grid will be welded at its ends to either frame member 68 or mast 18, and will additionally be welded to each of the perpendicularly extending bars at the intersections therewith. As long as the distance between these bars does not exceed one-tenth of the wavelength of the signal being transmitted, the grid will operate to establish a ground plane as effectively as a continuous sheet of conductive material. As indicated in FIG. 2, these reflectors will preferably be dimensioned to each extend 0.7λ axially, and 0.33λ radially.

When antenna bay 10 is constructed and dimensioned as set forth above, each CP antenna 12, 14, and 16 will have a horizontal field pattern with a beam width of approximately 120°. Since the CP antennas are spaced 120° apart around the mast, a substantially omnidirectional horizontal pattern will result.

Figure 4:
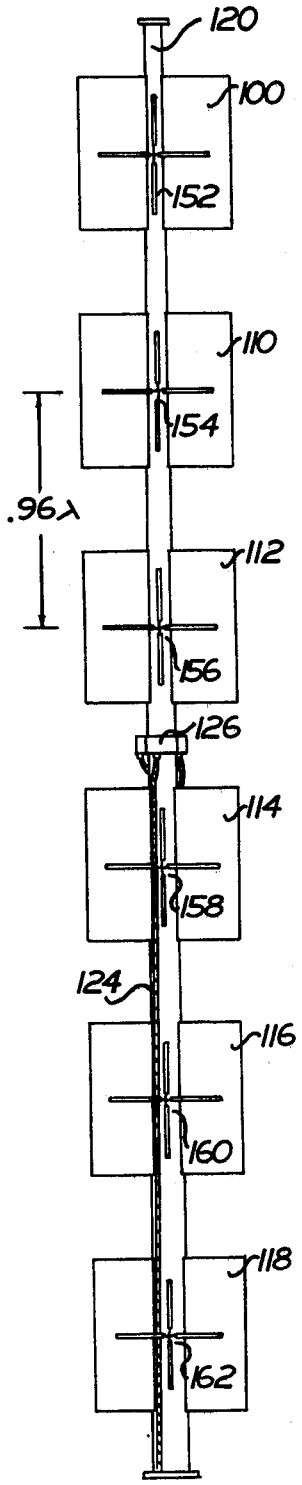
FIG. 4 is an elevation view of a multi-bay circularly polarized antenna in accordance with the teachings of the present invention; and, FIG. 5 is a schematic illustration of a feed network for feeding the multi-bay antenna of FIG. 4.

Referring now to FIG. 4, a multi-bay antenna in accordance with the present invention is shown. For the lower frequency VHF channels (channels 2–6), the antenna will include six bays, as illustrated. These bays 100–118 will each be constructed as shown in FIGS. 1–3, and will be axially spaced along a single, common mast 120. For maximum gain, these bays will be spaced from one another so that the phase centers of the various bays (i.e. the centers of the dipoles) are 0.96λ apart. This preferred spacing is possible since the vertical and horizontal dipoles of each circularly polarized antenna have a common phase center. In addition, the six bays will be circumferentially positioned so that the three faces of each bay will line up with the three faces of the other bays. As illustrated in FIG. 4, the mast 120 about which these bays are constructed may be tapered in form. In this manner, the weight of the mast may be reduced without impairing the structural integrity thereof.

Figure 5:
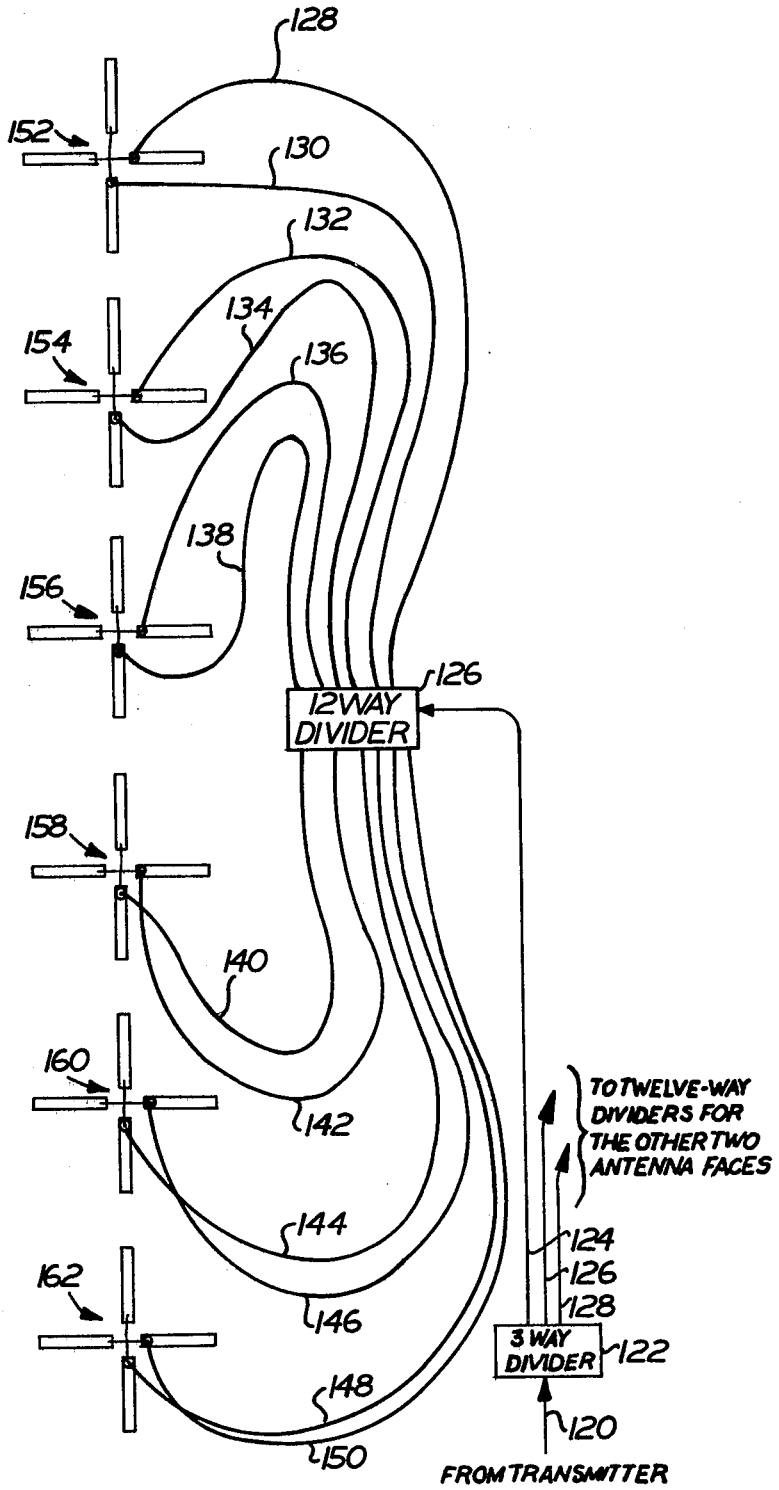

Referring now to FIG. 5, a system for feeding the antenna of FIG. 4 is particularly illustrated. The feed line 120 from the transmitter is connected to a three-way divider 122 having three output lines 124, 126, and 128. The divider serves to divide the power of the signal being fed along feed line 120 equally among the three output lines 124–128. Divider 122 additionally operates in such a manner that the signals supplied to output lines 124, 126, and 128 are in phase with one another.

Each output line 124, 126, and 128 supplies a signal to a network for feeding one of the three faces of each of the six bays. Since these feed networks are identical, only the feed network supplied by output line 124 will be described.

A twelve-way divider 126 is provided which operates in a fashion similar to three-way divider 122. Equal power, in-phase signals are supplied to twelve output lines 128–150.

One face of each of the antenna bays is connected to two of the output lines of divider 126. For example, the dipoles of antenna 152 are connected to lines 128 and 130. These lines are interconnected with each antenna in the same manner in which feed lines 48 and 50 are interconnected with antenna 12 (FIGS. 1–3). To insure that the crossed dipoles of each antenna are properly phased, one of each pair of lines is λ/4 shorter than the other. Thus, lines 128, 132, 136, 142, 146, and 160 are all the same length and are each λ/4 shorter than lines 130, 134, 138, 140, 144, and 148. Since the lines feeding each antenna are the same length as the lines feeding the other antennas, the electromagnetic waves radiated by antennas 152–162 are in phase. Beam tilt and null fill may be controlled by altering the relative phasing of lines 128–150.

Three-way divider 122 may be conveniently located at the top of the tower, immediately below the mast. Lines 124, 126, and 128 would then each run up the side of the mast to the twelve way dividers, which would be located at the center of the mast (FIG. 4).

Although the invention has been described with respect to a preferred embodiment, it will be appreciated that various rearrangements and alterations of parts may be made without departing from the spirit and scope of the invention, as defined in the appended claims.

What is claimed is:

1. A circularly polarized antenna bay comprising a single vertically oriented support mast having a longitudinal axis, three generally planar reflectors, each disposed with respect to said mast such that said longitudinal axis of said support mast essentially lies within said plane of said reflector, whereby said reflectors extend radially from said support mast, said reflectors being equally spaced circumferentially about said mast so as to define three ground planes generally parallel to said mast and equally spaced circumferentially thereabout, said reflectors being wholly supported by said mast, three pairs of crossed dipoles, and means for feeding said pairs so that each radiates circularly polarized electromagnetic waves, said pairs each being located at circumferential positions intermediate said reflectors and each including radiating elements extending generally across the corresponding said ground plane but with said radiating elements each extending towards said ground plane at angles selected so as to substantially equalize the E and H plane patterns thereof.

2. A circularly polarized antenna bay as set forth in claim 1 wherein the two dipoles of each pair of dipoles have a common geometric center, thereby establishing a common phase center, and wherein said means for phasing the two dipoles of each of said pairs of crossed dipoles comprises means for feeding the two dipoles of each of said pairs substantially 90° out of phase with one another whereby each of said pairs of crossed dipoles radiates circularly polarized electromagnetic waves.

3. A circularly polarized antenna bay as set forth in claim 1 wherein said reflectors each comprises a planar grid of electrically conductive members.

4. A multi-bay circularly polarized antenna comprised of a plurality of circularly polarized antenna bays, each as defined in claim 1, wherein said bays are axially spaced along a common vertically oriented longitudinal axis and wherein said axial spacing is selected to provide maximum antenna gain.

5. A multi-bay circularly polarized antenna comprising: a single antenna mast having a vertically oriented longitudinal axis; and, plural antenna bays axially spaced along said mast and supported thereby, wherein each of said bays comprises three pairs of crossed dipoles at substantially the same axial position along said mast and equally spaced circumferentially thereabout, means for feeding said pairs of crossed dipoles so that each of said pairs radiates circularly polarized electromagnetic waves, and three generally planar, radially extending electrically conductive reflectors, with said reflectors being disposed with respect to said mast such that the planes of said three reflectors all intersect along a single line generally coincident with said longitudinal axis of said mast, said reflectors being located at circumferential positions intermediate said pairs of crossed dipoles, thereby defining substantially vertically oriented ground planes separating said three pairs of crossed dipoles, and further wherein each of said pairs of crossed dipoles comprises first and second orthogonally disposed dipoles having a common phase center and each having radiating elements extending towards the corresponding said ground plane at an angle selected to equalize the E and H plane patterns of each of said dipoles whereby each of said pairs of crossed dipoles provides good axial ratio at substantially all locations in the radiating pattern thereof.

6. A multi-bay circularly polarized antenna as set forth in claim 5 wherein the axial spacing of said antenna bays along said mast is such that the phase centers of said pairs of crossed dipoles of different said bays are spaced to provide maximum antenna gain.

7. A circularly polarized antenna comprising:

a vertically oriented longitudinal support mast, a plurality of generally planar, vertically disposed, reflectors supported by said support mast and each extending radially from the longitudinal axis of said support mast, said reflectors being equally spaced circumferentially about said longitudinal axis and disposed with respect to said axis such that the planes of all said reflectors intersect along a single line which is essentially co-linear with said axis of said mast, a similar plurality of crossed dipole pairs supported by said support mast, said pairs being equally spaced circumferentially about said longitudinal axis and each pair being disposed between a pair of said reflectors whereby each of said reflectors defines a partial ground plane for two of the immediately adjacent said dipole pairs, and means for feeding said crossed dipole pairs with electromagnetic energy so that said pairs each radiate circularly polarized electromagnetic waves, each two of said reflectors together defining an entire ground plane for the dipole pair disposed therebetween, each said dipole pair including radiating elements each extending toward said ground plane defined by the two adjacent reflectors so as to substantially equalize the E and H plane patterns thereof.

8. A circularly polarized antenna as set forth in claim 7 wherein there are three each of said reflectors and dipole pairs.

9. A circularly polarized antenna as set forth in claim 8 wherein each said reflector comprises a single generally planar open grid of electrically conductive members having low windload characteristics.

* * * * *